US010326241B2

(12) United States Patent
Jacobson

(10) Patent No.: US 10,326,241 B2
(45) Date of Patent: Jun. 18, 2019

(54) ICUBELOCK

(71) Applicant: Ira Sheldon Jacobson, Coral Gables, FL (US)

(72) Inventor: Ira Sheldon Jacobson, Coral Gables, FL (US)

( * ) Notice: Subject to any disclaimer, the term of this patent is extended or adjusted under 35 U.S.C. 154(b) by 0 days.

(21) Appl. No.: 15/717,708

(22) Filed: Sep. 27, 2017

(65) Prior Publication Data

US 2019/0097355 A1 Mar. 28, 2019

(51) Int. Cl.
*H01R 13/639* (2006.01)

(52) U.S. Cl.
CPC ..... *H01R 13/6395* (2013.01)

(58) Field of Classification Search
CPC ..... H01R 13/6395
See application file for complete search history.

(56) References Cited

U.S. PATENT DOCUMENTS 3,811,104 A * 5/1974 Caldwell ..... H01R 13/6395 439/135
4,105,274 A * 8/1978 Casey ..... H01R 13/6395 439/368
4,424,407 A * 1/1984 Barbic ..... H01R 13/447 174/67
4,895,527 A * 1/1990 Brown ..... H01R 13/447 439/147
D359,271 S * 6/1995 Reinholt ..... D13/156
5,574,256 A * 11/1996 Cottone ..... H01R 13/6395 174/53
7,939,757 B1 * 5/2011 Baldwin ..... H02G 3/14 174/66
9,147,973 B1 * 9/2015 Madison ..... H01R 13/6395
D823,263 S * 7/2018 Cyzen ..... D13/156
2009/0149055 A1 * 6/2009 Uchikawa ..... H01R 13/6395 439/367
2015/0194832 A1 * 7/2015 Benigno ..... H02J 7/0044 320/111
2017/0214201 A1 * 7/2017 Armstrong ..... H01R 31/06
2019/0006793 A1 * 1/2019 Watkins, Jr. ..... H01R 13/6395

* cited by examiner

*Primary Examiner* — James Harvey

(57) ABSTRACT

A bracket to lock cell phone chargers or other electronic chargers to an electrical outlet into which they are plugged. This is to prevent unauthorized borrowing, theft or other removal of said chargers or charging wires.

2 Claims, 7 Drawing Sheets

ICUBELOCK

CROSS REFERENCE TO RELATED APPLICATIONS

Provisional patent application 62/495,912 dated Sep. 29, 2016

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATED-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Field of the Invention

This invention relates to H01R CPC Classification. To be more specific, this invention pertains to an anti-theft bracket to secure and facilitate the interconnection of one or more electric components, i.e., charging modules, connecting electric cords to an electrical outlet to thereby secure it against unauthorized removal or theft.

Description of Related Art

In FIG. 1 is illustrated prior art known as ichargerlock. This device is limited to the specific charger provided and can be attached only to the older style double oval socket having one mounting screw but not to the newer Decora style socket having two mounting screws. It cannot be used to secure chargers of other shapes or dimensions to the electrical outlet. In other words, only their supplied proprietary charger can be used. In distinction to my invention, the iCubeLock, will secure a wide variety of chargers available at a multitude of retail outlets to either the older style double oval socket having one mounting screw or to the Decora style socket having two mounting screws.

BRIEF DESCRIPTION OF THE SEVERAL VIEWS OF THE DRAWINGS

The iCubeLock is a new product. It is a device to secure one or two cell phone chargers or other chargers of other personal electronic devices and charging cables to the electrical outlet as illustrated in FIG. 6, thereby discouraging theft or unauthorized "borrowing" of the chargers. It mounts on the electrical outlet using the same screw holes as the outlet cover plate as seen in FIG. 2. The iCubeLock accommodates a wide range or variety of chargers, including those for laptop computers and cameras. It would be indispensable in a home or office with multiple occupants who are cell phone users, such as children, who are constantly losing or misplacing the chargers. Equally, in an office, work station, lunch or coffee break room, one could secure their charger and be confident that they could leave and the charger and cable will be there after leaving for other business, errands, lunch, meetings or overnight, without having to disconnect it and stuff it into pocket or handbag. It is made of non-conductive plastic.

Healthcare facilities, insurance, legal or other business offices, schools, classrooms, municipal and government offices would all find this useful.

BRIEF SUMMARY OF THE INVENTION

A device to lock cell phone chargers and accompanying cables to the electrical outlet providing power supply. This is to prevent unauthorized borrowing, theft or other removal of said chargers or charging wires. This structure is comprised of a (plastic) bracket that covers and secures the charging modules that are plugged into an electrical outlet, sufficiently to prevent theft or unauthorized removal, but also, by virtue of the open sided structure, allow use of a wide variety of different sized chargers.

DETAILED DESCRIPTION OF THE INVENTION

Figure 2:
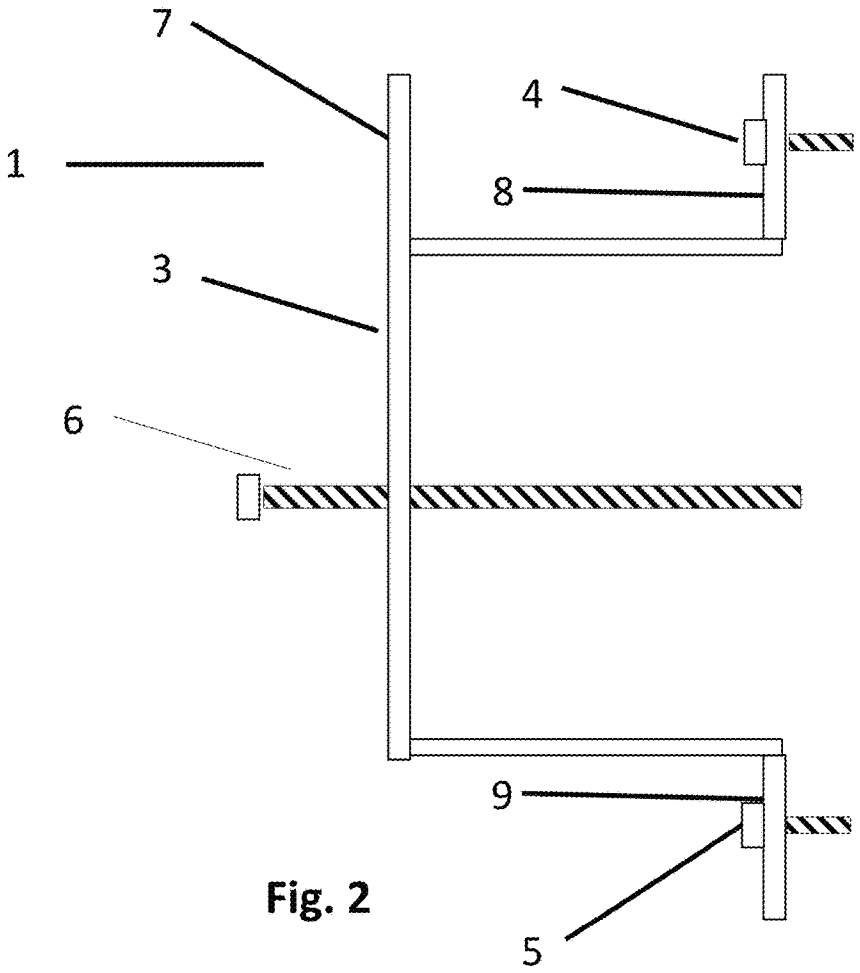
Figure 3:
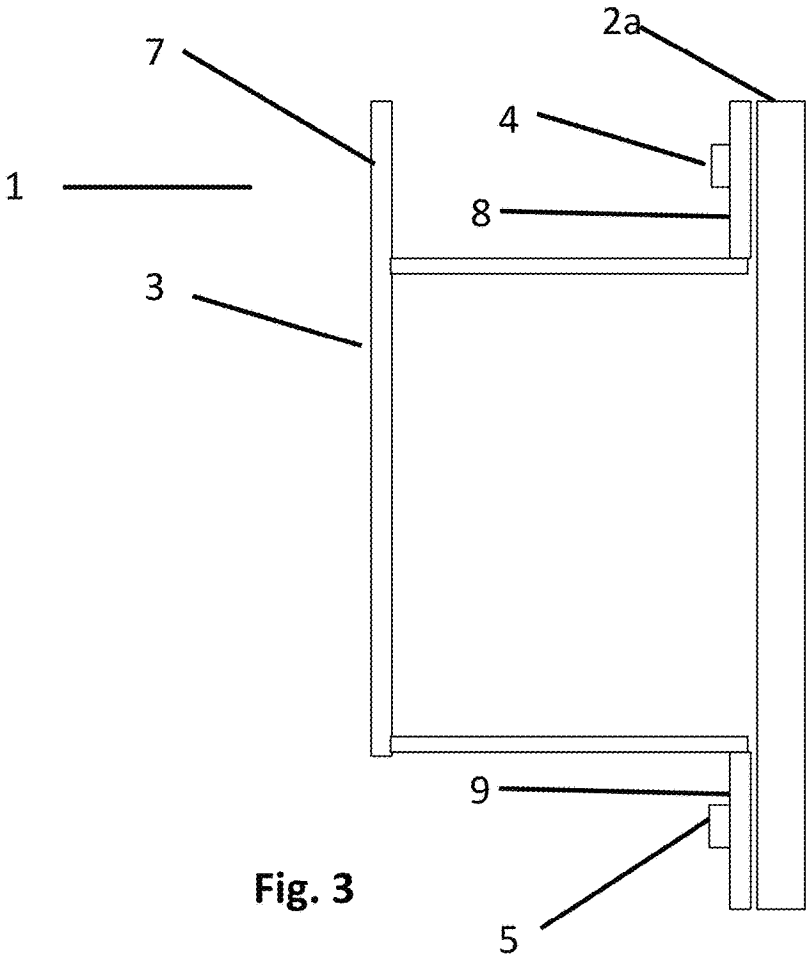
Figure 4:
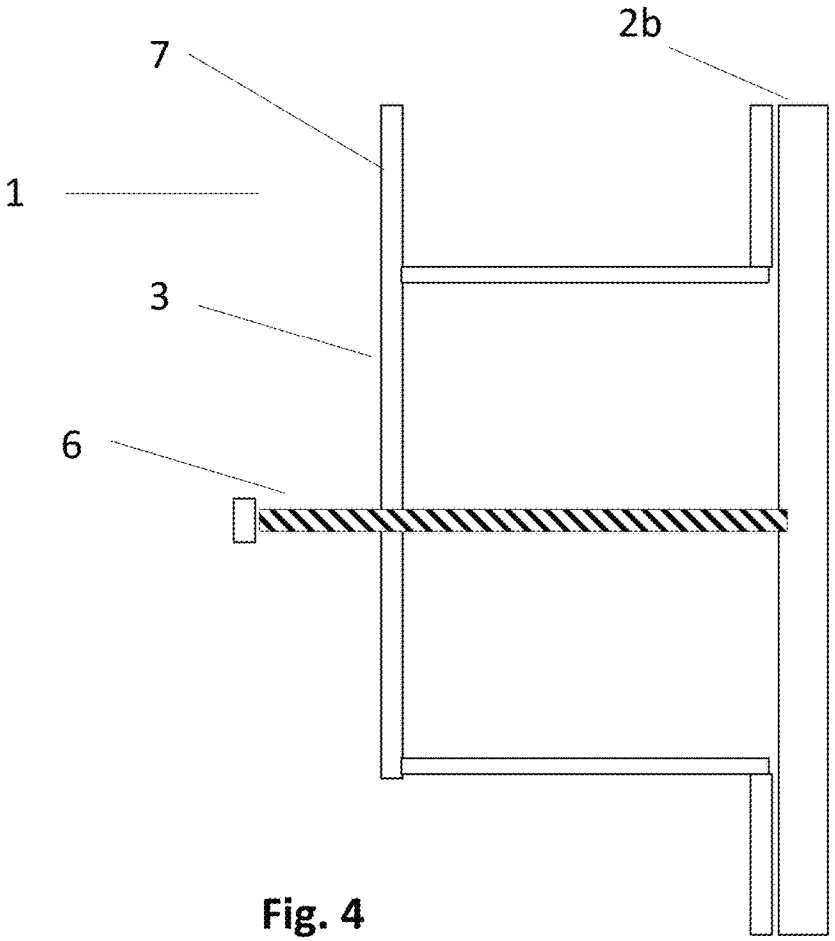

In FIG. 2 is a side view of iCubeLock 1. Faceplate 3 constitutes the front of iCubeLock 1 and tab 7 is an extension of faceplate 3 and provides for storing coiled cable. Screw 4 secures mounting flange top 8 and screw 5 secures mounting flange bottom 9 of iCubeLock 1 to faceplate 2*a* of Decora style electric outlet as illustrated in FIG. 3. Screw 6 fastens iCubeLock 1 to the older style double oval electrical outlet having one center screw as shown in FIG. 4.

Figure 5:
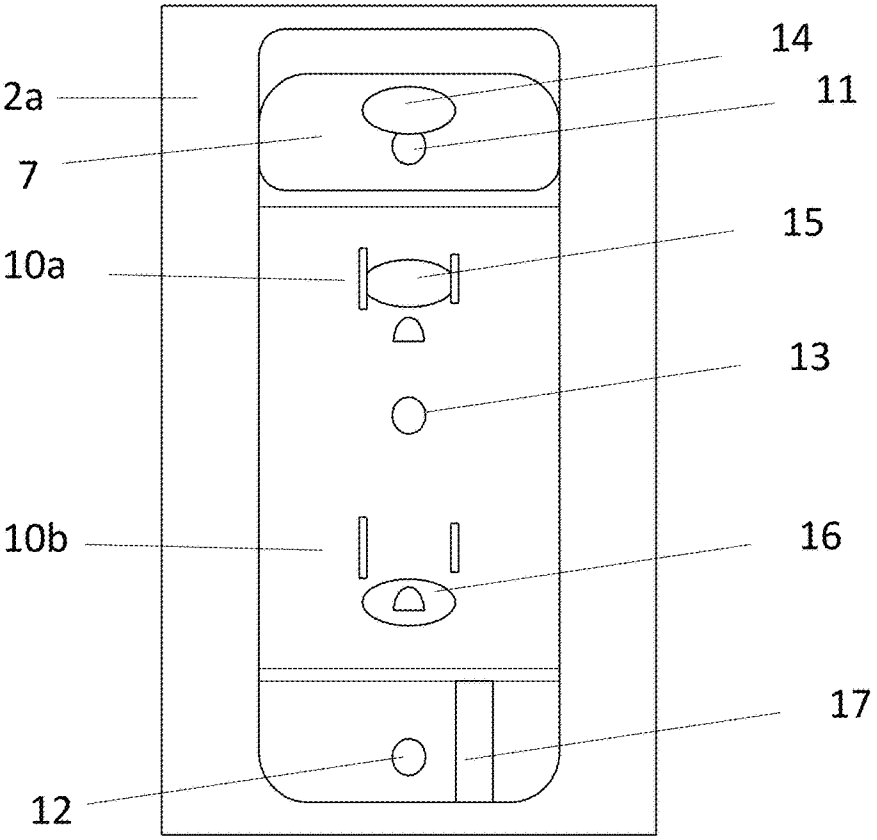
Figure 6:
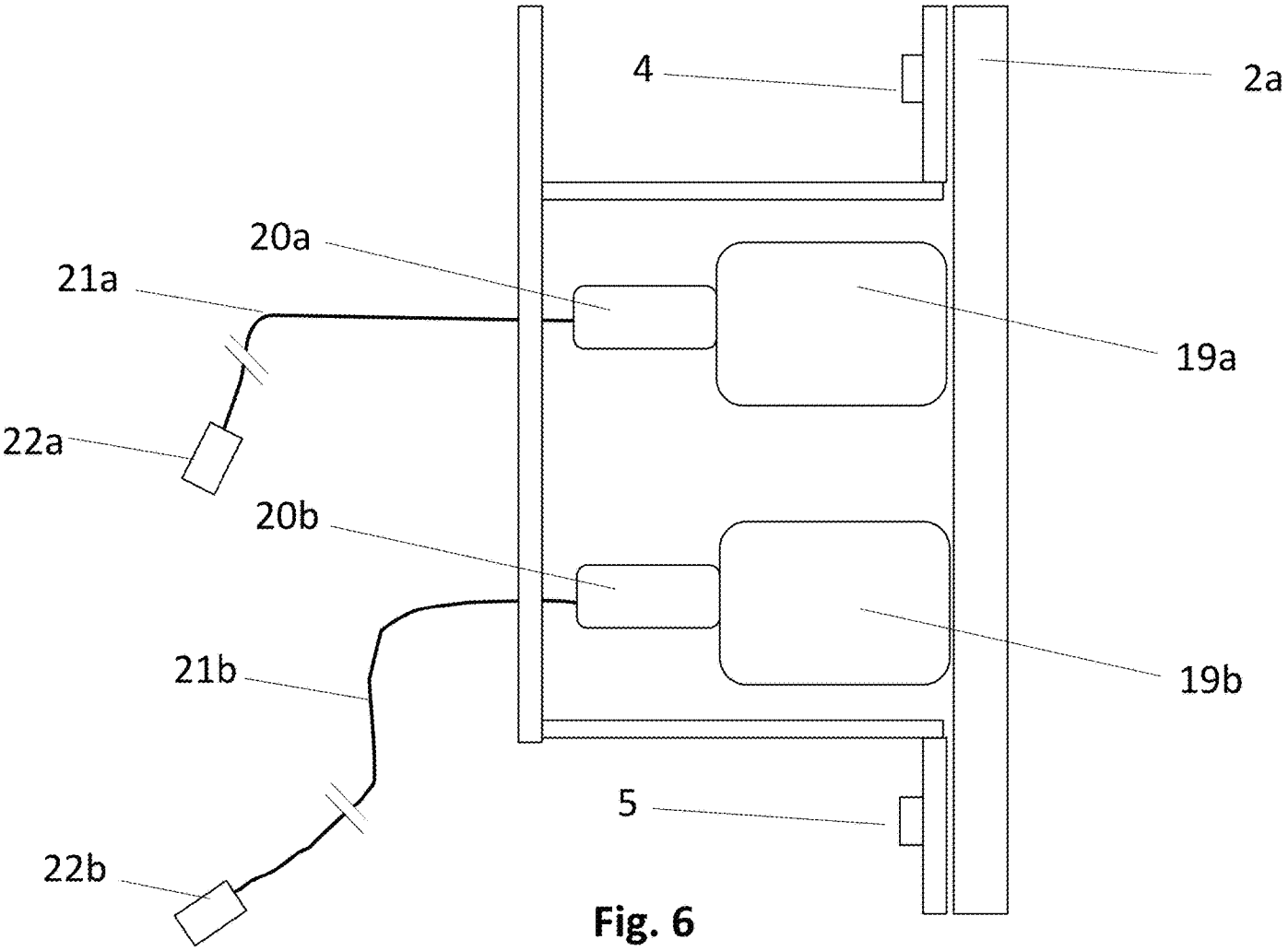

In FIGS. 5 and 6 are illustrated hole 11 in top flange 8 for passage of screw 4 and hole 12 in bottom flange 9 for passage of screw 5. Screws 4 and 5 secure iCubleLock 1 to Decora style faceplate 2*a*. Hole 13 is passage of screw 6 for securing iCubeLock 1 to old style double oval outlet faceplate 2*b*. A charging cable may be passed through opening 14 and coiled for compact storage, this cable may be either cable 21*a* or 21*b* having terminal connector 22*a* or 22*b* with a diameter smaller than that of opening 14. Opening 15 is for passage of charging cable 21*a* that inserts into top charger 19*a*. Opening 16 is for passage of charging cable 21*b* that inserts into lower charger 19*b*. Chargers 19*a* and 19*b* can be of different shapes and sizes. Electrical female receptacle 10*a* receive the prongs of charger 19*a* and receptacle 10*b* receives the prongs of charger 19*b*. Terminal connectors 22*a* and 22*b* are small enough to pass through openings 15 or 16.

Figure 8:
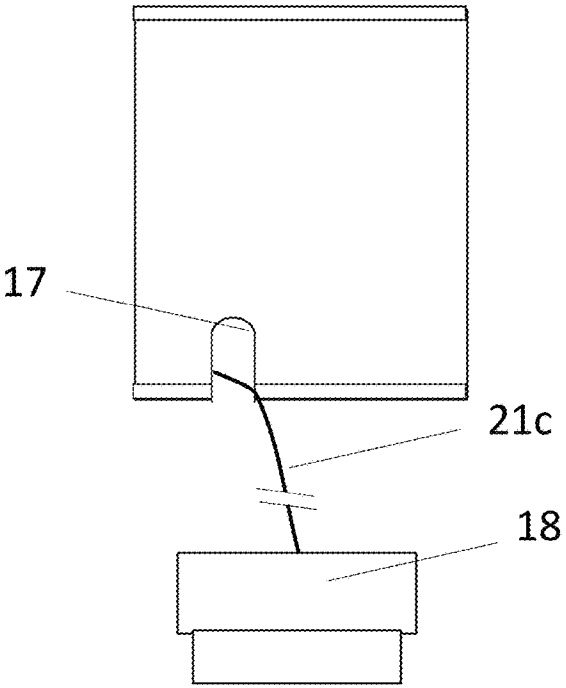
Figure 7:
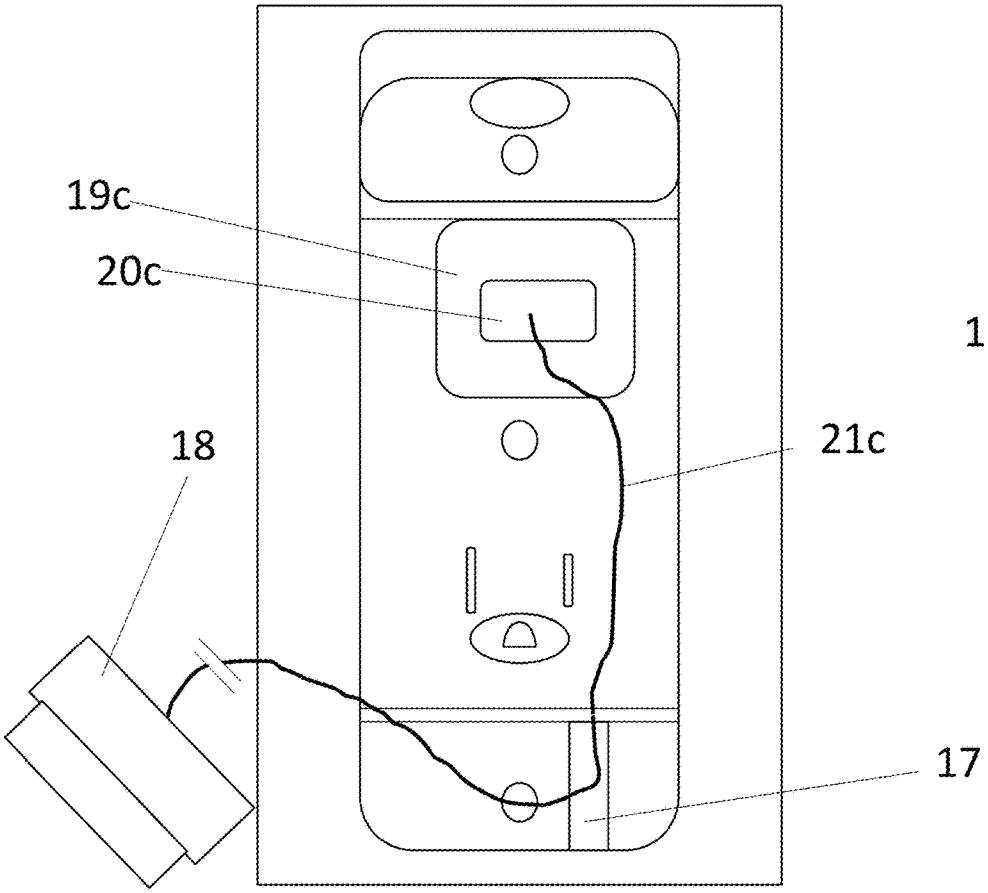

In FIG. 7 is a frontal view and in FIG. 8 is a bottom view showing slit 17, which provides passage of charging cable 21*c* having terminal connector 18 that is too large for passing through openings 15 or 16.

iCubeCharger 1 maybe produced by injection molding of a suitable plastic such as acrylic or styrene. Another method of production is by cutting sheet of plastic shape to proper shape and heat formed to the finished shape. Another method of production is a plastic stamping process.

The attaching screws may be the same screws 4 and 5 that attach electrical outlet faceplate cover 2*a*. Screw 6 must be of the length adequate to secure iCubeLock 1 though hole 13 into the center mounting hole of old style double oval electrical outlet 2*b*.

Installation instructions are as follows:

(1) Plug charger 19*a* into the electrical receptacle 10*a*.

(2) Pick up cable 21*a* and thread small connector 22*a* through opening 15 in the faceplate 3 of the iCubeLock 1. Terminal connector 22*a* connects to a cell phone or other electronic device. Starting from the inside (enclosed side) insert terminal connector 22*a* through opening 15 and pull cable 21*a* through until USB terminal 20*a* touches the inside of iCubeLock 1. Because the diameter of USB terminal 20*a* is greater than the diameter of opening 15, iCubeLock 1 captures and secures USB terminal 20*a* along with charging cable 21*a* to iCubeLock 1. The same procedure captures USB terminal 20*b* and charging cable 21*b* within iCubeLock 1 by threading small terminal connector 22*b* through opening 16.

(3) Remove the two screws holding the electrical outlet cover plate 2*a*, or the center screw for older style double oval style outlet 2*b*. Do not discard faceplate 2*a* or faceplate 2*b*.

4) Plug USB terminal 20*a* of charging cable 21*a* into the chargers 19*a* and plug charger 19*a* into receptacle 10*a*. Repeat the procedure for USB terminal 20*b* and charger 19*b*, plug charger 19*b* into receptacle 10*b*.

5) For Decora style outlet, remove screws 4 and 5 and align hole 11 of iCubeLock 1 with the top screw hole in faceplate 2*a* and align hole 12 of iCubeLock 1 with the bottom hole in faceplate 2*a*, then insert and tighten screws 4 and 5. Use screws 4 and 5 removed from faceplate 2*a* if long enough. If not, use longer screws.

6) For the older style double oval sockets with single central screw fastening faceplate 2*b*, remove the central screw holding faceplate 2*b* in place, be careful not to remove faceplate 2*b*. Align hole 13 of iCubeLock 1 with the center screw hole in faceplate 2*b*, insert screw 6 through hole 13 and into said center screw hole of faceplate 2*b*. With iCubeLock in the vertical position, tighten screw 6 until iCubeLock 1 securely fastens to the faceplate 2*b*. Customary screw size is 3 inches long 6-32 SAE. Refer to drawings in FIGS. 2 through 4 to see positioning of iCubeLock1.

7) When using charging cable 21*c* having large terminal connector 18, which is too large for pass through openings 15 or 16, slit 17 is available. After plugging charger 19*c* into receptacle 10*a*, insert USB terminal 20*c* into charger 19*c*. Then pass charging cable 21*c*, through the slit 17 of bottom flange 9, so that it threads out of the iCubeLock through the bottom as shown in FIG. 8. Use instructions in 5 and 6 above to fasten iCubeLock 1 to either faceplate 2*a* or 2*b*.

8) Tab 7 of iCubeLock 1 is used to store charging cable 21 *a, b* or *c* when coiled-up or similarly arranged. Charging cable terminal connector 22*a* and 22*b* can pass through the opening 14 in tab 7 for securing cables 21*a* and 21*b*.

LIST OF DRAWINGS

Figure 1:
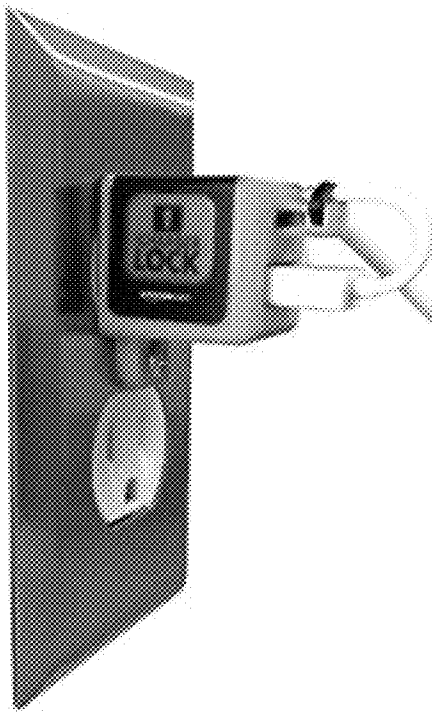
Fig. 1 Prior Art

FIG. 1 shows photograph of prior art, the ichargerlock.

FIG. 2 is a side view of iCubeLock 1 and screws for different applications.

FIG. 3 is a side view of iCubeLock 1 attached to Decora style electrical outlet faceplate 2*a* using two screws.

FIG. 4 is a side view of iCubeLock 1 attached to an old style double oval style electrical outlet faceplate 2*b* using one screw.

FIG. 5 is a frontal view of iCubeLock 1 overlying Decora style faceplate 2*a*.

FIG. 6 is a side view of iCubeLock 1 attached to faceplate 2*a* showing chargers and cables.

FIG. 7 is frontal view of iCubeLock 1 showing a charger 19*c* with connecting cable 21*c* having terminal connector 18 that is too large to pass through holes 15 or 16 so the cable is passed through slit 17 and thereby secured.

FIG. 8 a bottom view of iCubeLock 1 of cable illustrated in FIG. 7.

The invention claimed is:

1. A device consisting of a three-sided structure that attaches to an electrical outlet having a. an internal space open to the sides that houses one or more electrical charger modules that plug into said outlet b. a front side, c. a top side with an angled flange d. a bottom side with an angled flange e. openings suitable for the passage of charging cables and yet entrapping the USB module connector, f. a slit allowing insertion and securing of a charging cable having a large terminal connector unable to pass through said openings, f. screw holes in said angled flanges aligned with the mounting screw holes of a modern square Decora outlet cover plate and g. a screw hole in the center of the front side aligned with the center screw hole of a standard traditional electrical double oval faceplate, whereby said device secures chargers and cables from unauthorized removal or theft.

2. The device of claim 1 having a tab on the said topside for storing a coiled-up charging cable.

* * * * *